US010234183B2

(12) United States Patent
Hashimoto et al.

(10) Patent No.: US 10,234,183 B2
(45) Date of Patent: Mar. 19, 2019

(54) COMPRESSING DEVICE

(71) Applicant: Kobe Steel, Ltd., Kobe-shi (JP)

(72) Inventors: Koichiro Hashimoto, Takasago (JP); Kazumasa Nishimura, Takasago (JP); Shigeto Adachi, Takasago (JP); Yutaka Narukawa, Takasago (JP); Haruyuki Matsuda, Kobe (JP); Tetsuya Kakiuchi, Takasago (JP); Noboru Tsuboi, Kako-gun (JP); Kazunori Fukuhara, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 259 days.

(21) Appl. No.: 14/793,922

(22) Filed: Jul. 8, 2015

(65) Prior Publication Data

US 2016/0069600 A1 Mar. 10, 2016

(30) Foreign Application Priority Data

Sep. 5, 2014 (JP) ..... 2014-180814

(51) Int. Cl.
*F25B 49/02* (2006.01)
*F25B 41/04* (2006.01)
(Continued)

(52) U.S. Cl.
CPC ..... *F25B 49/02* (2013.01); *F01K 13/02* (2013.01); *F04C 23/006* (2013.01); *F04C 29/04* (2013.01); *F25B 41/04* (2013.01)

(58) Field of Classification Search
CPC .. F25B 49/02; F25B 9/06; F25B 11/02; F25B 2600/2501; F25B 40/06; F25B 2400/04; F01K 13/02; F04C 23/006
See application file for complete search history.

(56) References Cited

U.S. PATENT DOCUMENTS 9,347,338 B2 * 5/2016 Yamamoto ..... F01K 15/00
2003/0213246 A1 * 11/2003 Coll ..... F01K 17/02 60/653
(Continued)

FOREIGN PATENT DOCUMENTS

CN 103147812 A 6/2013
CN 103670553 A 3/2014
(Continued)

OTHER PUBLICATIONS

Extended European Search Report dated Nov. 16, 2015 in Patent Application No. 15175439.7.

*Primary Examiner* — Keith Raymond
*Assistant Examiner* — Kamran Tavakoldavani
(74) *Attorney, Agent, or Firm* — Oblon, McClelland, Maier & Neustadt, L.L.P.

(57) ABSTRACT

A compressing device of the present invention comprises a compressor, a heat exchanger, an expander, a power recovery unit, a condenser, a pump, a bypass flow passage for bypassing the expander, and a bypass valve. When a bypass condition for allowing a working medium to circulate through the bypass flow passage is satisfied, the bypass valve is caused to be opened, thereby allowing the working medium to circulate between the heat exchanger and the condenser through the bypass flow passage. As a result, a compressed gas discharged from the compressor is cooled by the working medium in the heat exchanger. This configuration makes it possible to cool the compressed gas by the working medium in the heat exchanger regardless of operation conditions of the expander.

7 Claims, 2 Drawing Sheets

(51) Int. Cl.

| | |
|---|---|
| ***F04C 23/00*** | (2006.01) |
| ***F04C 29/04*** | (2006.01) |
| ***F01K 13/02*** | (2006.01) |

(56) References Cited

U.S. PATENT DOCUMENTS

| | | | | |
|---|---|---|---|---|
| 2008/0134699 | A1* | 6/2008 | Leaver | F25B 41/062 62/129 |
| 2009/0090118 | A1* | 4/2009 | Pham | F04B 39/06 62/228.5 |
| 2009/0211253 | A1 | 8/2009 | Radcliff et al. | |
| 2011/0011101 | A1* | 1/2011 | Hikawa | F25B 11/02 62/6 |
| 2011/0100007 | A1* | 5/2011 | Carrick | F01K 21/047 60/645 |
| 2012/0067047 | A1* | 3/2012 | Peterson | C02F 1/22 60/651 |
| 2013/0036757 | A1* | 2/2013 | Okaichi | F25B 1/10 62/196.1 |
| 2013/0269380 | A1* | 10/2013 | Oya | F25B 41/043 62/190 |
| 2014/0075941 | A1 | 3/2014 | Adachi et al. | |
| 2014/0102103 | A1* | 4/2014 | Yamamoto | F01K 15/00 60/658 |
| 2014/0137582 | A1* | 5/2014 | Louvar | F25B 25/005 62/119 |
| 2014/0165562 | A1 | 6/2014 | Nagai et al. | |
| 2015/0121877 | A1 | 5/2015 | Kamiya | |

FOREIGN PATENT DOCUMENTS

| | | | |
|---|---|---|---|
| EP | 2 708 704 | A2 | 3/2014 |
| JP | 2005-30727 | A | 2/2005 |
| JP | 2011-12659 | | 1/2011 |
| JP | 2012-132454 | A | 7/2012 |
| JP | 2013-57256 | A | 3/2013 |
| JP | 2013-526682 | A | 6/2013 |
| JP | 2014-58877 | A | 4/2014 |
| JP | WO2014/087639 | A1 | 6/2014 |
| KR | 10-2008-0019268 | A | 3/2008 |
| WO | WO 2006/138459 | A2 | 12/2006 |
| WO | WO 2014/112326 | A1 | 7/2014 |

* cited by examiner

COMPRESSING DEVICE

BACKGROUND OF THE INVENTION

Field of the Invention

The present invention relates to a compressing device.

Description of the Related Art

There has been known a compressing device that recovers heat energy of a compressed gas discharged from a compressor. For example, JP 2011-012659A discloses a compressor that includes a compressor body, a heat exchanger for exchanging heat between a compressed air discharged from the compressor body and a working fluid, an expander for expanding the working fluid flowing out of the heat exchanger, a generator connected to the expander, a condenser for condensing the working fluid flowing out of the expander, and a circulation pump for sending the working fluid flowing out of the condenser to the heat exchanger. In this compressor, the heat energy received by the working fluid from the compressed air in the heat exchanger is recovered in the expander and the generator, and, on the one hand, the compressed air is supplied to an outside after being cooled by the working fluid in the heat exchanger.

In the compressor described in JP 2011-012659 A above, when the expander is stopped in operation at the time of maintenance of the expander or the like, the working fluid is unable to circulate in a flow channel connecting the heat exchanger and the expander, and the compressed air is not sufficiently cooled by the working fluid in the heat exchanger. This results in raising a possibility of suspending operation of the compressor as well.

Similarly, when the expander is rotated at a low speed, the working fluid is unable to sufficiently circulate in the flow channel, thus the compressed air is not sufficiently cooled in the heat exchanger.

The present invention has been made in view of the aforementioned problems, and has an object to perform cooling of a compressed gas by a working medium in a heat exchanger regardless of operation conditions of an expander.

SUMMARY OF THE INVENTION

As a means for solving the aforementioned problems, a compressing device of the present invention comprises a compressor for compressing a gas and a heat energy recovery unit for recovering heat energy of a compressed gas discharged from the compressor by employing a Rankine cycle using a working medium, wherein the heat energy recovery unit includes a heat exchanger for recovering heat of the compressed gas by exchanging heat between the compressed gas and the working medium, an expander for expanding the working medium that is heat-exchanged with the compressed gas in the heat exchanger, a power recovery unit for recovering a power from the expander, a condenser for condensing the working medium flowing out of the expander, a pump for sending the working medium flowing out of the condenser to the heat exchanger, a circulation flow passage connecting the heat exchanger, the expander, the condenser, and the pump, a bypass flow passage connected to the circulation flow passage for bypassing the expander, a bypass valve for opening and closing the bypass flow passage, a shut-off valve for shutting off an inflow of the working medium into the expander, and a control unit for switching between a state where the working medium is circulated in the circulation flow passage through the expander and a state where the working medium is circulated in the circulation flow passage through the bypass flow passage by controlling the bypass valve and the shut-off valve.

According to the present invention, when a predetermined condition is satisfied during operation of the compressor, the working medium is continuously circulated in the circulation flow passage by detouring the expander through the bypass flow passage regardless of operation conditions of the expander, thus the compressed gas can be cooled by the working medium in the heat exchanger.

It is preferred that the compressing device having the aforementioned configuration further comprises a temperature sensor for detecting a temperature of the working medium, arranged between the heat exchanger and the expander in the circulation flow passage and a pressure sensor for detecting a pressure of the working medium, arranged between the heat exchanger and the expander in the circulation flow passage, wherein the control unit calculates a superheat degree of the working medium using the temperature obtained by the temperature sensor and the pressure obtained by the pressure sensor, and adjusts an inflow amount of the working medium into the heat exchanger so that the superheat degree becomes a predetermined lower limit value or more, the predetermined lower limit value being greater than or equal to zero, and also becomes a predetermined upper limit value or less by controlling a rotation speed of the pump during the state where the working medium is circulated in the circulation flow passage through the bypass flow passage.

In this manner, the working medium flowing into the heat exchanger in a liquid phase flows out from the heat exchanger in a state of saturated vapor or superheated vapor. This means that this configuration allows the use of latent heat of the working medium, thus the compressed gas can be cooled more efficiently as compared with a case of using sensible heat alone. Further, by suppressing an increase in the superheat degree, the quantity of the sensible heat of the working medium is suppressed, thus the compressed gas can be cooled more efficiently.

It is preferred that, in the compressing device having the aforementioned configuration, the control unit stops the expander and also performs a control so as to circulate the working medium in the circulation flow passage through the bypass flow passage, when a predetermined stop condition of the expander is satisfied.

In this manner, the working medium is allowed to circulate the circulation flow passage even in a state where the expander is stopped, thus the compressed gas can be cooled.

It is preferred that, in the compressing device having the aforementioned configuration, the heat exchanger includes a gas flow passage through which the compressed gas discharged from the compressor flows, a first flow passage through which the working medium flows, arranged in a position capable of exchanging heat between the working medium and the compressed gas, and a second flow passage through which a cooling fluid for cooling the compressed gas flows, arranged in a position capable of exchanging heat between the cooling fluid and the compressed gas.

In this manner, the compressed gas flowing through the gas flow passage is cooled by the working medium flowing through the first flow passage, and is also cooled by the cooling fluid flowing through the second flow passage.

It is further preferred that, in the heat exchanger, the first flow passage is arranged on an upstream side of the second flow passage in a flow direction of the compressed gas.

In this manner, heat energy of the compressed gas is effectively recovered by the working medium flowing through the first flow passage before the compressed gas is cooled by the cooling fluid flowing through the second flow passage, thus making it possible to recover more energy from the compressed gas by the working medium.

It is preferred that, if the first flow passage and the second flow passage are included, the gas flow passage is an inner space of a casing of the heat exchanger, the first flow passage and the second flow passage are tubes extending in the inner space in a meandering manner, and a plurality of fins are formed on outer wall faces of the first flow passage and the second flow passage.

In such a mode, the heat exchanger is a so-called fin tube type, where the compressed gas flows through the inner space of the casing, thus a pressure loss caused in the compressed gas can be reduced as compared with a case of circulating the compressed gas through a pipe. Further, the first flow passage and the second flow passage are the tubes extending in a meandering manner, thus heat can be efficiently recovered from the compressed gas. Further, by providing the fins, a contact area between the compressed gas and the first flow passage and a contact area between the compressed gas and the second flow passage are each increased, thus a cooling efficiency of the compressed gas is further improved.

As described above, according to the present invention, it becomes possible to cool a compressed gas by a working medium in a heat exchanger regardless of operation conditions of an expander.

DESCRIPTION OF THE PREFERRED EMBODIMENTS

Hereinafter, a compressing device 1 according to one embodiment of the present invention will be described with reference to FIGS. 1 and 2.

Figure 1:
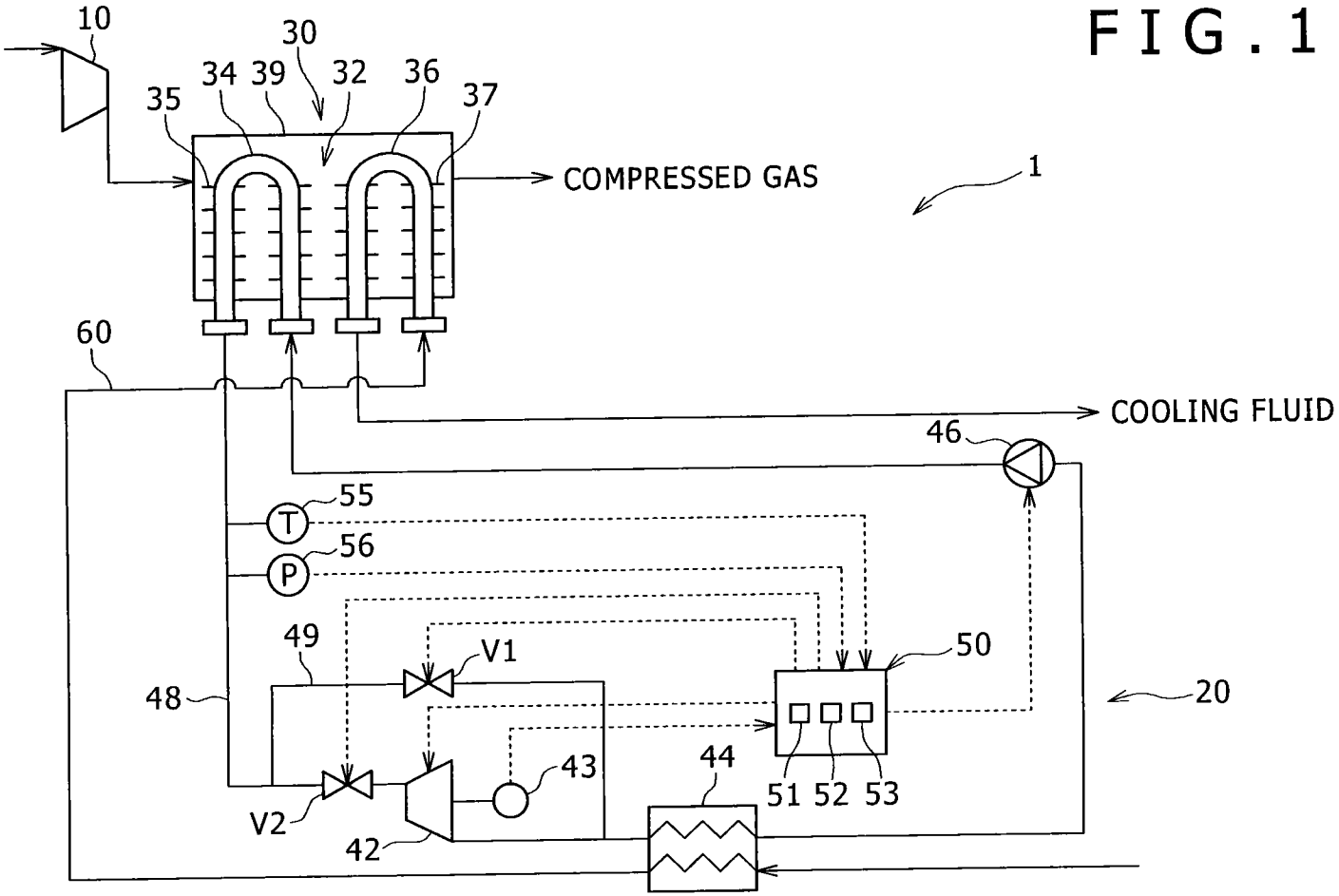
FIG. 1 is a schematic view of a configuration of a compressing device according to one embodiment of the present invention.
Figure 2:
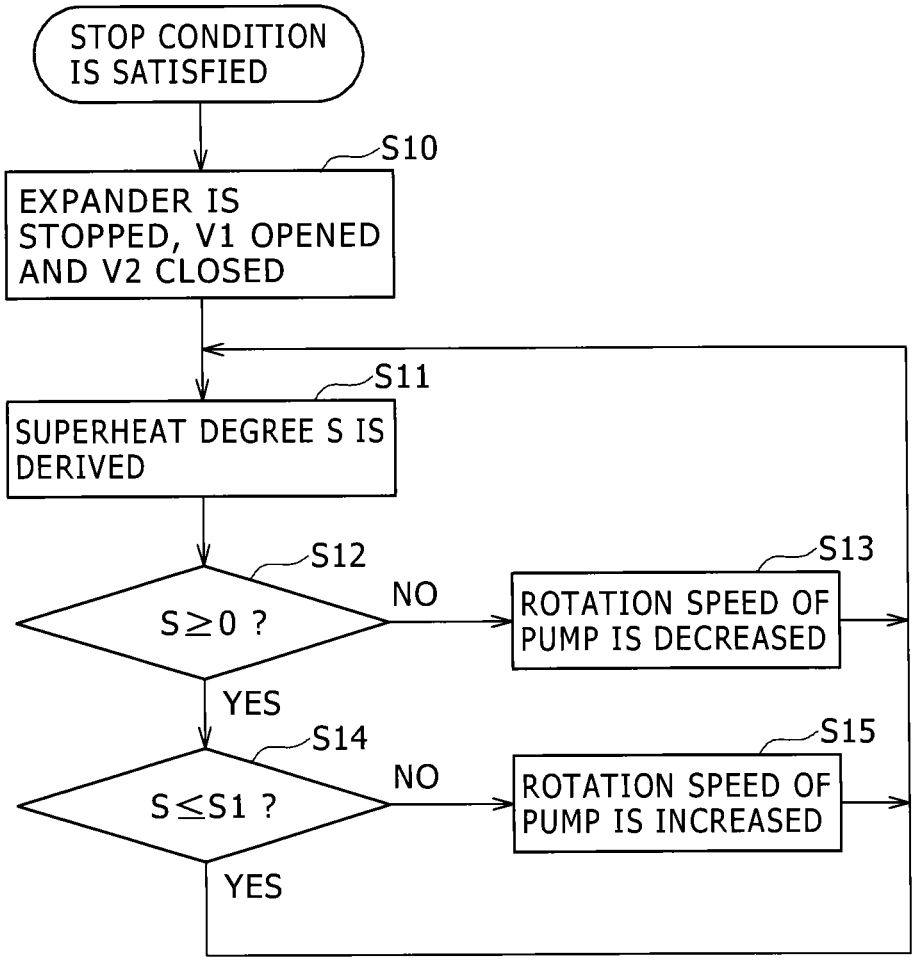
FIG. 2 is a flowchart showing control contents of a control unit.

As shown in FIG. 1, the compressing device 1 comprises a compressor 10 for compressing a gas (an air in the present embodiments) and a heat energy recovery unit 20.

The heat energy recovery unit 20 recovers heat energy of a compressed gas discharged from the compressor 10 by employing a Rankine cycle using a working medium. Specifically, the heat energy recovery unit 20 includes a heat exchanger 30, an expander 42, a generator 43 serving as a power recovering unit, a condenser 44, a pump 46, a circulation flow passage 48, a bypass flow passage 49, a bypass valve V1, a shut-off valve V2, and a control unit 50. In the present embodiments, an organic fluid having a boiling point lower than that of water is used as the working medium.

The heat exchanger 30 is a fin tube type and includes a gas flow passage 32 through which the compressed gas flows, a first flow passage 34, and a second flow passage 36. The gas flow passage 32, the first flow passage 34, and the second flow passage 36 are included in a casing 39 of the heat exchanger 30. The gas flow passage 32 is an inner space formed in the casing 39, and the first flow passage 34 and the second flow passage 36 are tubes extending in the inner space in a meandering manner. A plurality of fins 35 are formed on an outer wall face of the first flow passage 34. A plurality of fins 37 are formed on an outer wall face of the second flow passage 36. The second flow passage 36 is arranged on a downstream side of the first flow passage 34 in a flow direction of a compressed gas in the gas flow passage 32.

End parts of the first flow passage 34 are connected to the circulation flow passage 48, while end parts of the second flow passage 36 are connected to a cooling fluid flow passage 60. The working medium is circulated through the circulation flow passage 48 and a cooling fluid for cooling the compressed gas (a cooling water in the present embodiments) is circulated through the cooling fluid flow passage 60. In this configuration, the compressed gas discharged form the compressor 10 is first cooled by exchanging heat with the working medium circulating through the first flow passage 34, then further cooled by exchanging heat with the cooling fluid circulating through the second flow passage 36, in the gas flow passage 32, and subsequently supplied to an outside. It is noted that a cooling fluid other than the cooling water may be also used.

In the circulation flow passage 48, the heat exchanger 30, the expander 42, the condenser 44, and the pump 46 are connected in series in this order.

The expander 42 is arranged on a downstream side of the heat exchanger 30 in the circulation flow passage 48. In the present embodiments, a screw expander is used as the expander 42, in which case, a pair of screw rotors contained in the screw expander are rotationally driven by expansion energy of the vapor-phase working medium flowing out of the heat exchanger 30. As the expander 42, a centrifugal expander, a scroll-type expander, and the like may be also used.

The generator 43 is connected to the expander 42. The generator 43 is equipped, as incidental equipment, with electronic devices such as an invertor and a convertor for adjusting outputs. The generator 43 has a rotary shaft connected to at least one of the pair of screw rotors of the expander 42. The generator 43 produces electric power as the rotary shaft rotates with a rotation of the screw rotors.

The condenser 44 is arranged on a downstream side of the expander 42 in the circulation flow passage 48. The condenser 44 condenses (liquefies) the working medium by cooling with the cooling fluid. In the present embodiments, as a fluid for exchanging heat with the working medium in the condenser 44, the cooling fluid used in the heat exchanger 30 is used. By sharing a cooling fluid between the condenser 44 and the heat exchanger 30, the compressing device 1 can be down sized.

The pump 46 is arranged on a downstream side of the condenser 44 (a portion between the condenser 44 and the heat exchanger 30) in the circulation flow passage 48. The pump 46 pressurizes a liquid-phase working medium previously condensed in the condenser 44 to a prescribed pressure and sends it to the heat exchanger 30. As the pump 46, a centrifugal pump having impellers as a rotor, a gear pump having a pair of gears to form a rotor, a screw pump, a trochoid pump, and the like may be used.

The bypass flow passage 49 is connected to the circulation flow passage 48 so as to bypass the expander 42. Specifically, one end (an upstream-side end part) of the bypass flow passage 49 is connected to a portion between the heat exchanger 30 and the expander 42 in the circulation flow passage 48, while the other end (a downstream-side end part) of the bypass flow passage 49 is connected to a portion between the expander 42 and the condenser 44 in the circulation flow passage 48.

The bypass valve V1 is arranged on the bypass flow passage 49. As the bypass valve V1, an open/close valve, a flow control valve, and the like may be used. The bypass valve V1 is closed when the expander 42 is rotated at a rated speed (i.e., when the heat energy recovery unit 20 is normally operated), and once the bypass valve V1 is operated to be opened, the working medium is allowed to flow into the condenser 44 through the bypass flow passage 49.

The shut-off valve V2 is arranged, in the circulation flow passage 48, on a downstream side of a connection part where the upstream-side end part of the bypass flow passage 49 is connected to the circulation flow passage 48, and on an upstream side of the expander 42. The shut-off valve V2 is opened when the expander 42 is rotated at a rated speed, and once the shut-off valve V2 is operated to be closed, a flow of the working medium into the expander 42 is shut off.

The control unit 50 includes an expander control section 51 for controlling the drive of the expander 42, a valve control section 52 for controlling the opening and closing of the bypass valve V1 and the shut-off valve V2, and an inflow control section 53 for controlling an inflow quantity of the liquid-phase working medium into the heat exchanger 30.

The inflow control section 53 controls a rotation speed of the pump 46 when the expander 42 is rotated at a rated speed. By this control, the inflow quantity of the liquid-phase working medium into the heat exchanger 30 is adjusted and a superheat degree of the vapor-phase working medium flowing out of the heat exchanger 30 is kept constant. In the present embodiments, the superheat degree of the working medium is calculated based on detection values of a temperature sensor 55 and a pressure sensor 56 provided between the heat exchanger 30 and the expander 42 in the circulation flow passage 48.

The expander control section 51 stops the expander 42 when a predetermined stop condition of the expander 42 or the generator 43 is satisfied. Specifically, the expander 42 is stopped by the expander control section 51 when a stop instruction is input to the compressing device 1 by an operator. Further, the expander 42 is also stopped by the expander control section 51 when at least one of the following parameters exceeds a corresponding prescribed allowance range: the pressure or the temperature of the working medium flowing into the expander 42; the rotation speed of the expander 42 or the generator 43; a frequency of electric power output from the generator 43; or a temperature inside of the generator 43. Besides, the expander 42 may be also stopped when: the control unit 50 detects a signal indicating a failure of electronic devices such as the invertor and the convertor incidental to the generator 43; an operator instructs an emergency stop; a liquid level of the working medium inside of the condenser 44 (or inside of a liquid receiver if the liquid receiver is used) falls below a set value; or a wear of a bearing used in the expander 42 and the generator 34 is detected.

At the time of operation of the compressing device 1, the gas is compressed by the compressor 10 and the resulting compressed gas having high temperature is flown into the heat exchanger 30. In the heat energy recovery unit 20, the pump 46 is started at the time of starting the compressor 10, thus allowing the working medium to circulate in the circulation flow passage 48. Also, the cooling fluid is sent out to the condenser 44 and the heat exchanger 30. It is noted that the starting of the compressor 10, the starting of the pump 46, and the sending-out of the cooling fluid to the heat exchanger 30 are not necessarily performed in the same time. The liquid-phase working medium flown into the heat exchanger 30 is heated by exchanging heat with the compressed gas and flows into the expander 42 as the vapor-phase working medium. On the other hand, the compressed gas is cooled by exchanging heat with the working medium and the cooling fluid, and then allowed to flow to a demand place.

In the expander 42, the screw rotors are driven by the expansion of the working medium and electric power is generated in the generator 43. The working medium flowing out of the expander 42 is condensed in the condenser 44 and sent out to the heat exchanger 30 again by the pump 46.

While the compressor 10 is in operation, or more precisely, while the compressed gas is flowing into the heat exchanger 30, if a bypass condition for allowing the working medium to circulate in the bypass flow passage 49 is satisfied, the bypass valve V1 is caused to be opened and the shutoff valve V2 is caused to be closed by the valve control section 52. In the present embodiments, the bypass condition is set in the same manner as the stop condition. That is, the valve control section 52 opens the bypass valve V1 and closes the shutoff valve V2 when the stop condition is satisfied during the operation of the compressor 10. In the heat energy recovery unit 20, even in a state that the expander 42 is stopped, the operation of the pump 46 is continued and the working medium is circulated in the circulation flow passage 48 (more precisely, a flow passage portion connecting the condenser 44, the pump 46, and the heat exchanger 30 in the circulation flow passage 48) through the bypass flow passage 49. Further, a supply of the cooling fluid to the condenser 44 is also continued. Hereinafter, a circulation of the working medium in the circulation flow passage 48 in a state where the bypass valve V1 is opened is referred to as a "forced circulation".

Next, control contents of the control unit 50 at the time of the forced circulation will be described with reference to FIG. 2.

As already mentioned, if the stop condition is satisfied, the expander control section 51 stops the expander 42, and the valve control section 52 opens the bypass valve V1 and closes the shut-off valve V2 (Step S10). It is noted that the control by the valve control section 52 may be performed at the same time as the control by the expander control section 51, or before and after the control by the expander control section 51.

Subsequently, the inflow control section 53 derives a superheat degree S based on each detection value of the temperature sensor 55 and the pressure sensor 56 (Step S11) and determines whether or not the superheat degree S is zero or more (Step S12). Based on this result, if it is determined that the superheat degree S is below zero (NO in Step 12), i.e., that an inflow rate of the liquid-phase working medium into the heat exchanger 30 is too high so that the liquid-phase working medium is flowing out from the heat exchanger 30, the inflow control section 53 reduces the rotation speed of the pump 46 (Step S13) and the Step 11 is repeated. In this step, a decrement amount of the rotation speed of the pump 46 is determined based on a previously prepared table.

On the other hand, if it is determined that the superheat degree S is zero or more (YES in Step 12), it is then determined whether or not the superheat degree S is a predetermined upper limit value S1 or less (Step S14).

If the superheat degree S is greater than the predetermined upper limit value S1 (NO in Step14), i.e., if the inflow rate of the working medium into the heat exchanger 30 is too low so that the temperature of the vapor-phase working medium is raised excessively, the inflow control section 53 increases the rotation speed of the pump 46 (Step S15) and the Step 11 is repeated. In this step, an increment amount of the rotation speed of the pump 46 is determined based on a previously prepared table.

If the superheat degree S is zero or more and is also the predetermined upper limit value 51 or less (YES in Step 14), then the Step 11 is repeated without changing the rotation speed of the pump 46.

By the control performed by the inflow control section 53 explained above, the superheat degree of the working medium at the time of the forced circulation can be kept in a fixed range where a lower limit value thereof is zero or more and an upper limit value thereof is S1 or less. This control allows the use of more latent heat of the working medium, thus the compressed gas can be cooled more efficiently as compared with a case where the liquid-phase working medium flows out of the heat exchanger 30 or a case where the vapor-phase working medium having an excessively high temperature flows out of the heat exchanger 30. However, if the vapor-phase working medium having the superheat degree of slightly higher than zero flows out of the heat exchanger 30, there is a case where the working medium is converted into a gas-liquid dual phase by radiating heat at some midpoint before reaching the expander 42 and, as a result, the working medium in the gas-liquid dual phase flows into the expander 42. For this reason, a number value slightly higher than zero may be set as the lower limit value in the Step 12 in order to avoid the gas-liquid dual phase.

In the foregoing, a structure and operation of the compressing device 1 have been described. In a conventional device, if a stop condition is satisfied during operation of a compressor, an expander is caused to stop, and, as a result, a working medium is unable to circulate in a circulation flow passage through the expander. In contrast, in the compressing device 1, the working medium is allowed to continuously circulate in the circulation flow passage 48 through the bypass flow passage 49 even if the expander 42 is caused to stop. In this manner, the compressed gas can be continuously cooled by the working medium in the heat exchanger 30.

In the compressing device 1, if the bypass valve V1 is opened when the stop condition is satisfied, it is not necessarily to completely stop the expander 42. By rotating the expander 42 at a low speed, a part of the working medium flows into the expander 42, while the major part of the working medium flows into the bypass flow passage 49. In this case, the inflow control section 53 also adjusts the rotation speed of the pump 46 so that the superheat degree of the working medium flowing into the heat exchanger 30 is the lower limit value or more and the upper limit value S1 or less.

In the present embodiments, the first flow passage 34 is arranged on the upstream side of the second flow passage 36 in the heat exchanger 30, thus heat energy of the compressed gas is effectively recovered by the working medium flowing through the first flow passage 34 before the compressed gas is cooled by the cooling fluid flowing through the second flow passage 36. It is therefore possible to recover more energy from the compressed gas by the working medium.

In the heat exchanger 30, the compressed gas flows through the inner space of the casing 39, thus a pressure loss caused in the compressed gas can be reduced as compared with a case of circulating the compressed gas through a pipe. Further, the first flow passage 34 and the second flow passage 36 are tubes extending in a meandering manner, thus heat can be efficiently recovered from the compressed gas. Further, since a plurality of fins 35 and 37 are respectively formed on outer wall faces of the first flow passage 34 and the second flow passage 36, a contact area between the compressed gas and the first flow passage 34 and a contact area between the compressed gas and the second flow passage 36 are each increased, thus a cooling efficiency of the compressed gas is improved. It should be understood that the embodiments disclosed herein are illustrative and non-restrictive in every respect. The scope of the present invention is defined by the terms of the claims, rather than the description of the embodiments above, and is intended to include any modifications within the scope and meaning equivalent to the terms of the claims.

For example, when the heat energy recovery unit 20 is just started, more specifically, when the expander 42 is rotated at a low speed, lower than the rated speed, the bypass valve V1 may be configured to be opened to allow the working medium to circulate in the circulation flow passage 48 through the bypass flow passage 49. In this configuration, a part of the working medium flows through the expander 42. Also in this case, the inflow control section 53 adjusts the rotation speed of the pump 46 so that the superheat degree of the working medium flowing into the heat exchanger 30 is the lower limit value or more and the upper limit value S1 or less.

As exemplified above, the bypass condition for circulating the working medium through the bypass flow passage 49 is not necessarily the same as the stop condition mentioned above, and the bypass condition may be set on a situation where the expander 42 is not rotated or rotated at a low speed, i.e., a situation where the working medium can not be sufficiently circulated in the circulation flow passage 48 through the expander 42. As a result, the compressed gas can be cooled by the working medium in the heat exchanger 30 regardless of operation conditions of the expander 42.

Further, in the aforementioned embodiments, in addition to the bypass valve V1, an expansion valve may be arranged on the bypass flow passage 49. In this configuration, the working medium can be surely condensed during a stop of the expander 42 by adjusting an opening of the expansion valve and thereby expanding the vapor-phase working medium even in a case where the condenser 44 in use has a low cooling capacity.

Further, the aforementioned embodiments show an example where, at the time of the forced circulation, the inflow control section 53 adjusts the inflow amount of the liquid-phase working medium into the heat exchanger 30 by controlling the rotation speed of the pump 46, however a means for adjusting the inflow amount is not limited thereto. For example, after connecting a return flow passage to the circulation flow passage 48 so as to bypass the pump 46 and installing a return valve on the return flow passage, the inflow control section 53 may adjust the inflow amount of the liquid-phase working medium into the heat exchanger 30 by adjusting an opening of the return valve.

Further, the aforementioned embodiments show an example where the compressing device 1 includes a single compressor 10 and a single heat exchanger 30, however, the compressing device 1 may include two or more of compressors and heat exchangers. For example, when the compressing device 1 includes two compressors and two exchangers, the gas flow passage is arranged in such a manner that the compressed gas discharged from a first compressor is cooled by a first heat exchanger and further compressed by a second compressor, then after being cooled by a second heat exchanger, the compressed gas is supplied to an outside. Each of the heat exchangers may be arranged in series or in parallel on the circulation flow passage 48 for the working medium.

In the aforementioned embodiments, the first flow passage 34 and the second flow passage 36 may be separately formed in different heat exchangers. When the compressed gas is sufficiently cooled by the working medium, the second flow passage 36 may be removed from the heat exchanger 30.

As the bypass valve for controlling a flow of the working medium through the bypass flow passage 49, a switching valve for switching a flow of the working medium from the heat exchanger 30 to the bypass flow passage 49 and a flow of the working medium from the heat exchanger 30 to the expander 42 may be used. In the aforementioned embodiments, a rotary machine may be connected to the expander 42 as a power recovery unit.

The second flow passage 36 in the heat exchanger 30 and the condenser 44 (a flow passage thereof through which the cooling fluid circulates) may be arranged in parallel on the cooling fluid flow passage 60. Alternatively, the condenser 44 may be arranged on a downstream side of the second flow passage 36 on the cooling fluid flow passage 60.

As the heat exchanger 30, other heat exchangers such as a plate-type heat exchanger may be used. The generator 43 does not necessarily include the inverter or the converter.

What is claimed is:

1. A compressing device comprising:

a compressor for compressing a gas; and a heat energy recovery unit for recovering heat energy of a compressed gas discharged from the compressor by employing a Rankine cycle using a working medium, wherein the heat energy recovery unit includes:

a heat exchanger for recovering heat of the compressed gas by exchanging heat between the compressed gas and the working medium;

an expander for expanding the working medium that is heat-exchanged with the compressed gas in the heat exchanger;

a power recovery unit for recovering a power from the expander;

a condenser for condensing the working medium flowing out of the expander;

a circulation flow passage for connecting the heat exchanger, the expander, the condenser, and the pump;

a bypass flow passage for bypassing the expander, the bypass flow passage being connected to the circulation flow passage between the heat exchanger and the expander, and also being connected to the circulation flow passage between the expander and the condenser, whereby the working medium can bypass the expander by flowing in the bypass flow passage;

a bypass valve for opening and closing the bypass flow passage;

a shut-off valve for shutting off an inflow of the working medium into the expander, wherein the shut-off valve is provided in the circulation flow passage at a location between the expander and the point of connection of the bypass flow passage to the circulation flow passage between the heat exchanger and the expander;

a control unit for switching the bypass valve and shut-off valve between a state where the working medium is circulated in the circulation flow passage through the expander and a state where the working medium is circulated in the circulation flow passage through the bypass flow passage;

a temperature sensor for detecting a temperature of the working medium, arranged between the heat exchanger and the expander in the circulation flow passage; and a pressure sensor for detecting a pressure of the working medium, arranged between the heat exchanger and the expander in the circulation flow passage, wherein the control unit:

calculates a superheat degree of the working medium between the heat exchanger and the expander using the temperature obtained by the temperature sensor and the pressure obtained by the pressure sensor; and adjusts an inflow amount of the working medium into the heat exchanger so that the superheat degree becomes a predetermined lower limit value or more, the predetermined lower limit value being greater than or equal to zero, and also becomes a predetermined upper limit value or less, by controlling a rotation speed of the pump during the state where the working medium is circulated in the circulation flow passage through the bypass flow passage.

2. The compressing device according to claim 1, wherein the control unit stops the expander and also performs a control so as to circulate the working medium in the circulation flow passage through the bypass flow passage, when a predetermined stop condition of the expander is satisfied.

3. The compressing device according to claim 1, wherein the heat exchanger includes:

a gas flow passage through which the compressed gas discharged from the compressor flows;

a first flow passage through which the working medium flows, arranged in a position capable of exchanging heat between the working medium and the compressed gas; and a second flow passage through which a cooling fluid for cooling the compressed gas flows, arranged in a position capable of exchanging heat between the cooling fluid and the compressed gas.

4. The compressing device according to claim 3, wherein the first flow passage is arranged on an upstream side of the second flow passage in a flow direction of the compressed gas in the heat exchanger.

5. The compressing device according to claim 3, wherein:

the gas flow passage is an inner space of a casing of the heat exchanger;

the first flow passage and the second flow passage are tubes extending in the inner space in a meandering manner; and a plurality of fins are formed on outer wall faces of the first flow passage and the second flow passage.

6. A compressing device comprising:

a compressor for compressing a gas; and a heat energy recovery unit for recovering heat energy of a compressed gas discharged from the compressor by employing a Rankine cycle using a working medium, wherein the heat energy recovery unit includes:

a heat exchanger for recovering heat of the compressed gas by exchanging heat between the compressed gas and the working medium;

an expander for expanding the working medium that is heat-exchanged with the compressed gas in the heat exchanger;

a power recovery unit for recovering a power from the expander;

a condenser for condensing the working medium flowing out of the expander;

a circulation flow passage for connecting the heat exchanger, the expander, the condenser, and the pump;

a bypass flow passage for bypassing the expander, the bypass flow passage being connected to the circulation flow passage between the heat exchanger and the expander, and also being connected to the circulation flow passage between the expander and the condenser, whereby the working medium can bypass the expander by flowing in the bypass flow passage;

a bypass valve for opening and closing the bypass flow passage;

a shut-off valve for shutting off an inflow of the working medium into the expander, wherein the shut-off valve is provided in the circulation flow passage at a location between the expander and the point of connection of the bypass flow passage to the circulation flow passage between the heat exchanger and the expander;

a control unit for switching the bypass valve and shut-off valve between a state where the working medium is circulated in the circulation flow passage through the expander and a state where the working medium is circulated in the circulation flow passage through the bypass flow passage;

a temperature sensor for detecting a temperature of the working medium, arranged between the heat exchanger and the expander in the circulation flow passage; and a pressure sensor for detecting a pressure of the working medium, arranged between the heat exchanger and the expander in the circulation flow passage, wherein the control unit comprises:

means for calculating a superheat degree of the working medium between the heat exchanger and the expander using the temperature obtained by the temperature sensor and the pressure obtained by the pressure sensor; and means for controlling a rotation speed of the pump during the state where the working medium is circulated in the circulation flow passage through the bypass flow passage, such that the superheat degree becomes a predetermined lower limit value or more, the predetermined lower limit value being greater than or equal to zero, and also such that the superheat degree becomes a predetermined upper limit value or less.

7. The compressing device according to claim 1, further comprising an expansion valve in the bypass flow passage.

* * * * *